United States Patent [19]

Tsuruno et al.

[11] Patent Number: 4,702,019

[45] Date of Patent: Oct. 27, 1987

[54] APPARATUS FOR COOLING HIGH-TEMPERATURE PARTICLES

[75] Inventors: Masayoshi Tsuruno, Funabashi; Michihiko Horie, Nagareyama, both of Japan

[73] Assignees: Ishikawajima-Harima Jukogyo Kabushiki Kaisha; Ishikawajima Plant Engineering Kabushiki Kaisha, both of Tokyo, Japan

[21] Appl. No.: 883,346

[22] Filed: Jul. 8, 1986

[30] Foreign Application Priority Data

Jul. 17, 1985 [JP] Japan ..... 60-156019
Jul. 17, 1985 [JP] Japan ..... 60-156020

[51] Int. Cl.[4] ..... F26B 17/14

[52] U.S. Cl. ..... 34/168; 34/171; 34/20; 432/77; 432/83

[58] Field of Search ..... 34/168, 171, 172, 176, 34/20; 432/77, 78, 79, 81, 83, 84, 95, 96

[56] References Cited

U.S. PATENT DOCUMENTS 3,766,663 10/1973 Parsons ..... 34/168
4,624,059 11/1986 Hammarskog et al. ..... 34/168

*Primary Examiner*—Larry I. Schwartz

[57] ABSTRACT

An apparatus for cooling high-temperature particles in which various factors which adversely disturb the stability of the moving layer of high-temperature particles can be substantially eliminated and large-sized and medium-sized lumps contained in the high-temperature particles are forcibly broken into smaller particles for prevention of shutdown of a clinker burning process or the like.

3 Claims, 9 Drawing Figures

APPARATUS FOR COOLING HIGH-TEMPERATURE PARTICLES

BACKGROUND OF THE INVENTION

The present invention relates to an apparatus for cooling high-temperature particles and more particularly an apparatus for air-cooling high-temperature clinker in a cement burning process or for cooling high-temperature particles in a process of burning or sintering steel, lime stone or alumina.

Japanese Patent Application Nos. 2226/1983 (laid open under No. 128243/1984) and 2227/1983 (laid open under No. 128244/1984) disclose a cooling apparatus which can overcome the problems encountered in conventional grate type coolers for air-cooling high-temperature cement clinker. The above-mentioned cooling apparatus will be described with reference to FIGS. 8 and 9. First referring to FIG. 8, reference numeral 31 designates a first cooling zone in which high-temperature particles such as cement clinker is air-quenched; 32, a second cooling zone which is disposed below the first cooling zone 31 to gradually cool the cement clinker which has been quenched in the first cooling zone 31; and 33, a rotary kiln for burning cement.

The first cooling zone 31 comprises a vertical guide tube 34 which is disposed at the inlet and is adapted to temporarily hold high-temperature cement clinker and to prevent the cement clinker from being rapidly spread in the radially outward direction; a conical or pyramidal body 35 which has a large number of air distributing holes, is disposed coaxially with the guide tube 34, spaced apart therefrom by a predetermined distance and has a very gentle inclination angle smaller than an angle of repose; a motion acceleration device 36 which is vertically movable between the top of the conical or pyramidal body 35 and the guide tube 34, thereby accelerating the movement of cement clinker along the outer surface of the body 35 in the radially outward direction; and an air-cooling device 37 which supports the vertical guide tube 34 and is adapted to cool the outer surface thereof.

The second cooling zone 32 comprises a packed moving bed type cooling device 38 in which rapidly cooled cement clinker is packed into layers which move downward.

Still referring to FIG. 8, reference numeral 39 designates a control rod for controlling the downward movement of cement clinker; 40, a scraper ring; 41, a discharge scraper; 42, a turntable; 43, a conveyor for discharging the cooled cement clinker out of the system; 44, a main air supply line for supplying the air for cooling the high-temperature (or first cooling) zone; 45, a blower; 46, an air supply line for supplying the air for cooling the low-temperature (or second cooling) zone; 47, a blower; 48, an air compressor; 49, a directional control valve; 50, an air supply line for supplying the air to activate the motion acceleration device; 51, an auxiliary air supply line for supplying the air to cool the high-temperature zone; 52, an air discharge line for discharging air from the motion acceleration device; 53, a valve; and 54, an air supply line for supplying the combustion air to a calcination furnace.

Next referring to FIG. 9, the relationship among the vertical guide tube 34, the conical or pyramidal body 35 and the motion acceleration device 36 and the construction of the motion acceleration device 36 will be described. The motion acceleration device 36 is in the form of a piston whose upper end terminates into a cone with a large number of holes and is mounted on a stationary member 55 disposed below the guide tube 34 in coaxial relationship with the axis 56 of the guide tube 34 for vertical movement. The motion acceleration device 36 comprises a hollow conical head 57 with a bottom, an outer tube 58 and an inner tube 59 which are formed integral with the head 57. A high pressure chamber 60 is defined between the outer and inner tubes 58 and 59. The stationary member 55 comprises an inner tube 61 and an outer tube 62. A lower end portion of the inner tube 59 is inserted into the inner tube 61 while a lower portion of the outer tube 58 is air-tightly fitted over the outer tube 62. The motion acceleration device 36 is vertically slidable relative to the stationary member 55. The stationary member 55 has an air inlet 63 communicated with the air supply line 50, an air inlet 64 communicated with the auxiliary air supply line 51 and an air outlet communicated with the air discharge line 52.

With the cooling apparatus of the type described above, cement clinker 67 which is burned in the rotary kiln 33 to a high temperature of about 1350° C. is fed into the vertical guide tube 34 as indicated by a broken-line arrow 68, temporarily remains therein and then discharged over the conical or pyramidal body 35. Due to the slope of the conical or pyramidal body 35, the pressure of the air flowing upwards through the air distributing holes as indicated by the arrows 71 and the vertical movement of the motion acceleration device, cement clinker is distributed radially outwardly. Since cement clinker is forced to flow along the outer surface of the conical or pyramidal body 35 radially outwardly in the first cooling zone 31, it is rapidly and uniformly cooled to about 950° C. by the air flowing upwardly as indicated by the arrows 71. Cement clinker thus rapidly cooled is then fed into the packed moving bed type cooling device 38 which constitutes the second cooling zone 32 and is gradually cooled by the air supplied through the cooling air supply line 46. Cement clinker thus cooled is discharged by the conveyor 43 out of the system.

The air from the main air supply lines 44 is at room temperature and flows in the directions indicated by the arrows 69, 70, 71 and 72 so that the air is heated to about 1050° C. and is used as the combustion air in the rotary kiln 33. The air at room temperature from the cooling air supply line 46 passes through the packed moving bed type cooling device 38 and is heated to about 800° C. and flows into the air supply line 54 for supplying the combustion air into the calcination furnace.

The compressed air from the air compressor 48 is switched by the directional control valve 49 to flow into the air supply line 50 for supplying the air for activating the motion acceleration device or into the auxiliary air supply line 51 for supplying the cooling air to the high temperature zone. More particularly, as best shown in FIG. 9, the compressed air supplied through the auxiliary cooling air supply line 51 flows through the air inlet 64, the inner tube 61 and the inner tube 59 into the hollow space in the conical head 57. The air is discharged upwardly from the conical head 57 into the vertical guide tube 34, thereby mixing and cooling cement clinker remaining therein. When the compressed air is forced to flow through the air supply line 50 for supplying the air to activate the motion acceleration device, the valve 53 is closed. Then the compressed air from the line 50 flows into the air inlet 63 and through the space defined between the inner and outer tubes 61 and 62 to the high pressure chamber 60 where the compressed air is blocked. As a result, the motion acceleration device 36 is forced to move upwardly relative to the stationary member 55. On the other hand, when the supply of the compressed air to the line 50 is interrupted while the valve 53 is opened, the compressed air in the high pressure chamber 60 is discharged through the air discharged line 52 so that the motion acceleration device 36 is caused to move downwardly by its own weight relative to the stationary member 55. Thus, when the valve 53 is closed to introduce the compressed air through the line 50 into the high pressure chamber 60 and when the supply of the compressed air to the line 50 is interrupted while the valve 53 is opened, thereby discharging the compressed air from the high pressure chamber 60, the motion acceleration device 36 is forced to vertically move relative to the stationary member 55. In this case, a slight vertical stroke is sufficient enough to accelerate the movement of cement clinker along the outer surface of the conical or pyramidal body 35 so that the motion acceleration device vertically reciprocates a stroke indicated by 57 and 57*a*. However, when a large lump of cement clinker is fed into the vertical guide tube 34, the motion acceleration device is caused to move down to the position indicated by 57*b* so that the large lump drops not through the conical or pyramidal body 35 but directly downwardly and is discharged out of the cooling apparatus through a discharge port (not shown) later at a suitable time.

With the apparatus for cooling high-temperature particles of the type described above, the stability of the moving layer of high-temperature particles along the outer surface of the conical or pyramidal body is adversely affected due to the fluctuations in flow rate and pressure of the mixing and cooling air flowing through the motion acceleration device, the disturbances in mixing action in the high-temperature particle layer, the changes in pressure distribution between the high-temperature particle layers both caused by the vertical movement of the motion acceleration device, the variation in particle size distribution of the high-temperature particles fed from the rotary kiln, the response of the change in pressure distribution between the layers caused by the drop impact pressure, and the other variables of high-temperature particles in the vertical guide tube. For instance, high-temperature particles are abnormally forced to flow from the vertical guide tube to the conical or pyramidal body. As a result, the whole burning process including a step in the cooling apparatus is adversely affected.

Furthermore with the cooling apparatus of the type described above, in order to remove large and medium lumps in high-temperature particles, the motion acceleration device is forced to move to the lower dead point. Then the large and medium lumps are caused to drop together with the high-temperature particles remaining in the vertical guide tube and are removed out of the cooling apparatus later at a suitable time.

However, when large and medium lumps frequently admix in the high-temperature particles, they cannot be removed because of the insufficient capacity of the lower storage zone and because of a time required for naturally cooling the large and medium lumps dropped together with the high-temperature particles, resulting in shutdown of the rotary kiln and the cooling apparatus.

The present invention was made to overcome the above and other problems encountered in the cooling apparatus of the type described above.

A primary object of the present invention is, therefore, to provide an apparatus for cooling high-temperature particles in which variable factors in the vertical guide tube will not adversely affect the stability of the moving layer of high-temperature particles along the surface of the conical or pyramidal body.

A further object of the present invention is to provide an apparatus for cooling high-temperature particles in which high-temperature large and medium lumps mixed in the high-temperature particles from the rotary kiln can be crushed while their temperatures are still high, whereby the performacne of the cooling apparatus can be improved and enhanced.

The above and other objects, effects, features and advantages of the present invention will become more apparent from the following description of some preferred embodiments thereof taken in conjunction with the accompanying drawings.

DETAILED DESCRIPTION OF THE PREFERRED EMBODIMENTS

Figure 1:
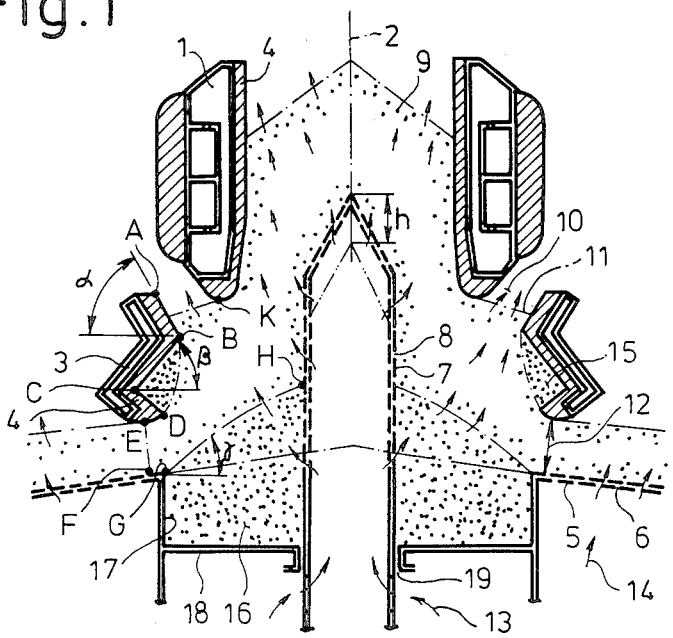
FIG. 1 is a vertical sectional view of a first embodiment of the present invention.
Figure 8:
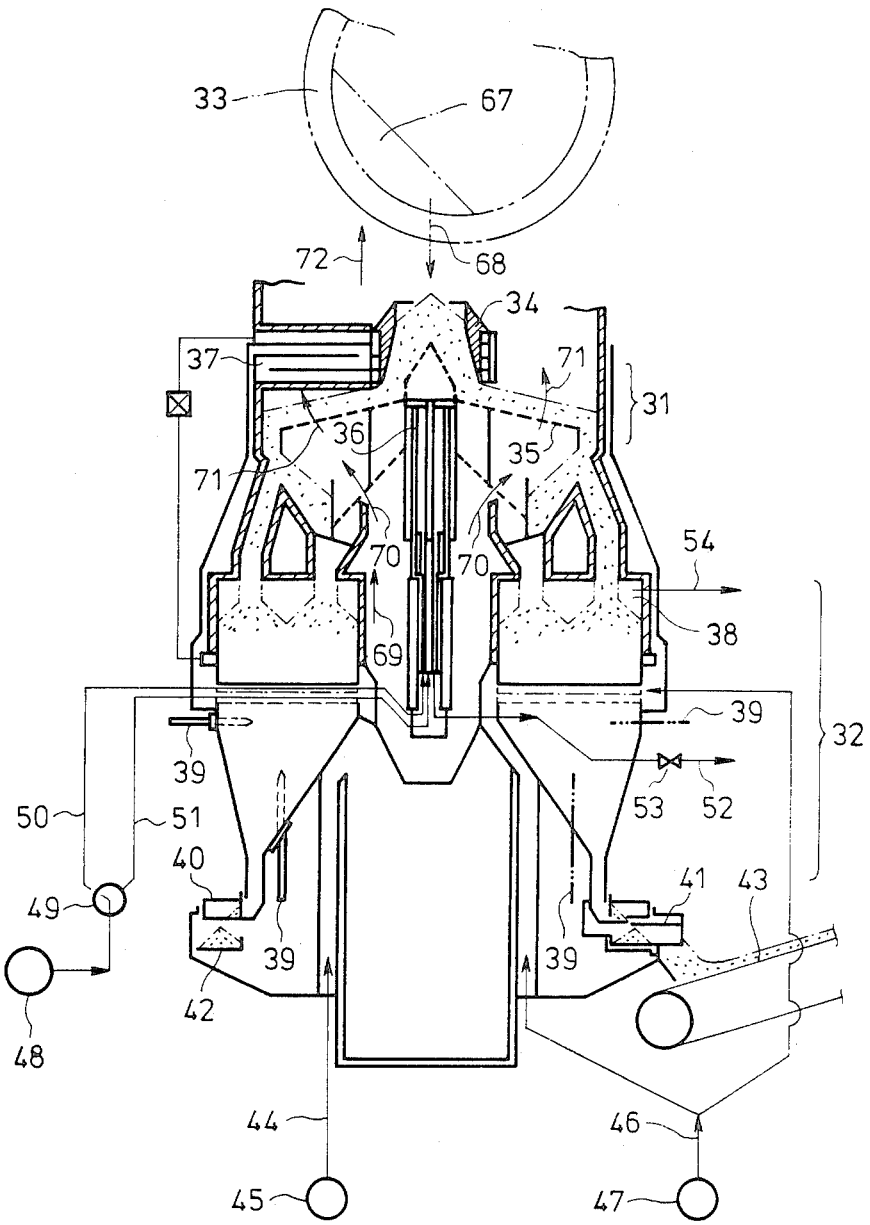
Fig. 8 PRIOR ART
FIG. 8 is a view used to explain a cooling apparatus.
Figure 9:
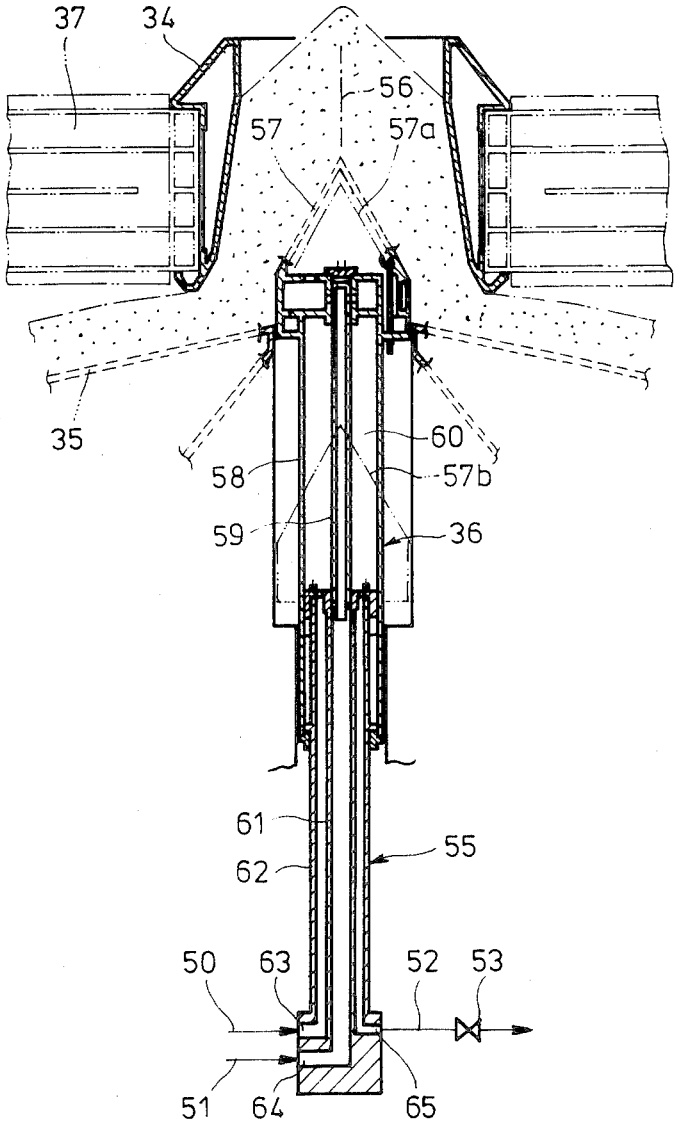
Fig. 9 PRIOR ART
FIG. 9 is a fragmentary view, on enlarged scale, thereof.

FIG. 1 shows a first embodiment of the present invention which is substantially similar in construction to the cooling apparatus described above with reference to FIGS. 8 and 9. In FIG. 1, reference numeral 1 designates a vertical guide tube for temporarily holding high-temperature particles such as high-temperature cement clinker discharged from a rotary kiln (not shown) and also for preventing the rapid spread of the high temperature particles in the radially outward directions; 2, an axis of the vertical guide tube 1; 3, a vertical outer tube which is disposed space below the vertical guide tube 1 in coaxial relationship therewith and defines together with the vertical guide tube 1 a double wall guide tube; 4, refractory brick or castable lining over the inner surfaces of the vertical guide tube 1 and outer tube 3; 5, a conical or pyramidal body which is disposed space below the outer tube 3 such that its imaginary vertex coincides with the axis 2 of the guide tube 1 and whose inclination angle is smaller than an angle of repose; 6, air holes formed through the conical or pyramidal body 5; 7, a motion acceleration device which extends from the top of the conical or pyramidal body 5 into the guide tube 1 and which is vertically movable so that the distribution in the radially outward directions of the particles along the outer surface of conical or pyramidal body 5 is accelerated, the top portion of the motion acceleration device 7 being in the form of a cone while the remaining portion is in the form of a cylinder; 8, air holes formed through the conical head and upper cylindrical wall portion of the motion acceleration device 7; 9, high-temperature particles; 10, an annular opening defined between the lower circular end of the guide tube 1 and the upper circular end of the outer tube 3; 11, a free surface of a high-temperature particle layer formed in the annular opening 10; 12, a gap for controlling the thickness of a layer formed between the lower end of the outer tube 3 and the conical or pyramidal body 5; 13, arrows indicating the directions of the air flowing through the motion acceleration device 7 into the guide tube 1, thereby mixing and cooling the high-temperature particles remaining therein; 14, arrows indicating the direction of the flows of the air for cooling the high-temperature particles 9 on the conical or pyramidal body 5; and h, a vertical stroke of the motion acceleration device 7 in the case of the normal operation thereof.

The inner surface of the outer tube 3 is composed by three conical surfaces concentric with the axis 2 of the guide tube 1 and having respective generating lines, i.e., a line segment AB which is inclined downwardly toward the axis 2, a line segment BC whose upper end is merged to a lower end of the line segment AB and which is located away from the axis 2 in the downward direction and a line segment CD whose upper end is merged to a lower end of the line segment BC and which is inclined downwardly toward the axis 2; thus the inner surface of the outer tube has a zigzag cross section. Both the angle $\alpha$ of inclination of the line segment AB and the angle $\beta$ of inclination of the line segment BC are sufficiently larger than an angle of repose and the line segments CD and BC are substantially perpendicular relative to each other. The position of the upper end A of the outer tube 3 is slightly higher than the position of the lower end K of the guide tube 1 to thereby prevent the overflow of the high-temperature particles 9 through the annular opening 10 and to ensure the stable formation of the free surface 11 of the high temperature particles 9. Since the angle $\alpha$ of inclination is greater than the angle of repose, the high-temperature particles 9 in the vicinity of the free surface 11 at the annular opening 10 smoothly flow down along the conical wall surface generated by the line segment AB. Since the angle $\beta$ of inclination is greater than the angle of repose, the high-temperature particles 9 are forced against the conical wall surface generated by the line segment BC. In addition, the conical wall surface generated by the line segment CD which is substantially perpendicular to the line segment BC serves to prevent the displacement of high-temperature particles 9. As a result, a tarrying zone 15 in which the high-temperature particles 9 remain is defined. The high-temperature particles 9 are displaced along the boundary surface generated by revolution of an arc BD about the axis 2. The gap 12 for controlling the thickness of the moving layer of high temperature particles along the outer surface of the conical or pyramidal body 5 is defined by a conical surface generated by revolution of a line segment EF about the axis 2 where E is the lower end of the outer tube 3 and the point F is on the inclined surface of the conical or pyramidal body 5 at which the line segment EF is perpendicular to the inclined surface of the conical or pyramidal body 5. The conical or pyramidal body 5 inside the layer thickness control gap 12 is formed with a cylindrical recess whose axis coincides with the axis 2. The air for mixing and cooling the high-temperature particles 9 remaining in the guide tube 1 is forced to flow through the gap 19 defined between the bottom 18 of the cylindrical recess and the motion acceleration device 7 and through the motion acceleration device 7 itself. The cylindrical wall 17 and the bottom 18 of the cylindrical recess are not formed with any air hole. Thus, a tarrying zone where the high-temperature particles stay is defined as indicated by the reference numeral 16. Therefore, the high-temperature particles 9 are displaced along the boundary surface generated by revolution of an arc GH about the axis 2. The angle $\alpha$ of inclination at the point G of the arc GH is substantially equal to the angle of repose.

Two surfaces of revolution generated by revolution of the arcs BD and GH, respectively, about the axis 2 define a passage of high-temperature particles 9 which converges gradually from and below the annular opening 10 toward the layer thickness control gap 12 on the conical surface. Therefore, the high-temperature particles 9 passing through this passage are applied with a suitable pressure. Furthermore, the free surface 11 itself of the high-temperature particles 9 in the annular opening 10 prevents disturbances by the various variable factors. As a result, various factors which disturb the stability of the moving layer of high-temperature particles formed on the conical or pyramidal body 5 can be substantially eliminated.

The advantage of forming the boundary surfaces of the passage by the arcs BD and GH in the layer of the high-temperature particles resides in the fact that in response to the displacement of the moving layer of high-temperature particles along the outer surface of the conical or pyramidal body 5, the high-temperature particles 9 are supplied through the layer thickness control gap 12 smoothly and at a predetermined flow rate. Therefore, no clogging occurs and the wear of the surfaces of the structual parts can be avoided.

Figure 5:
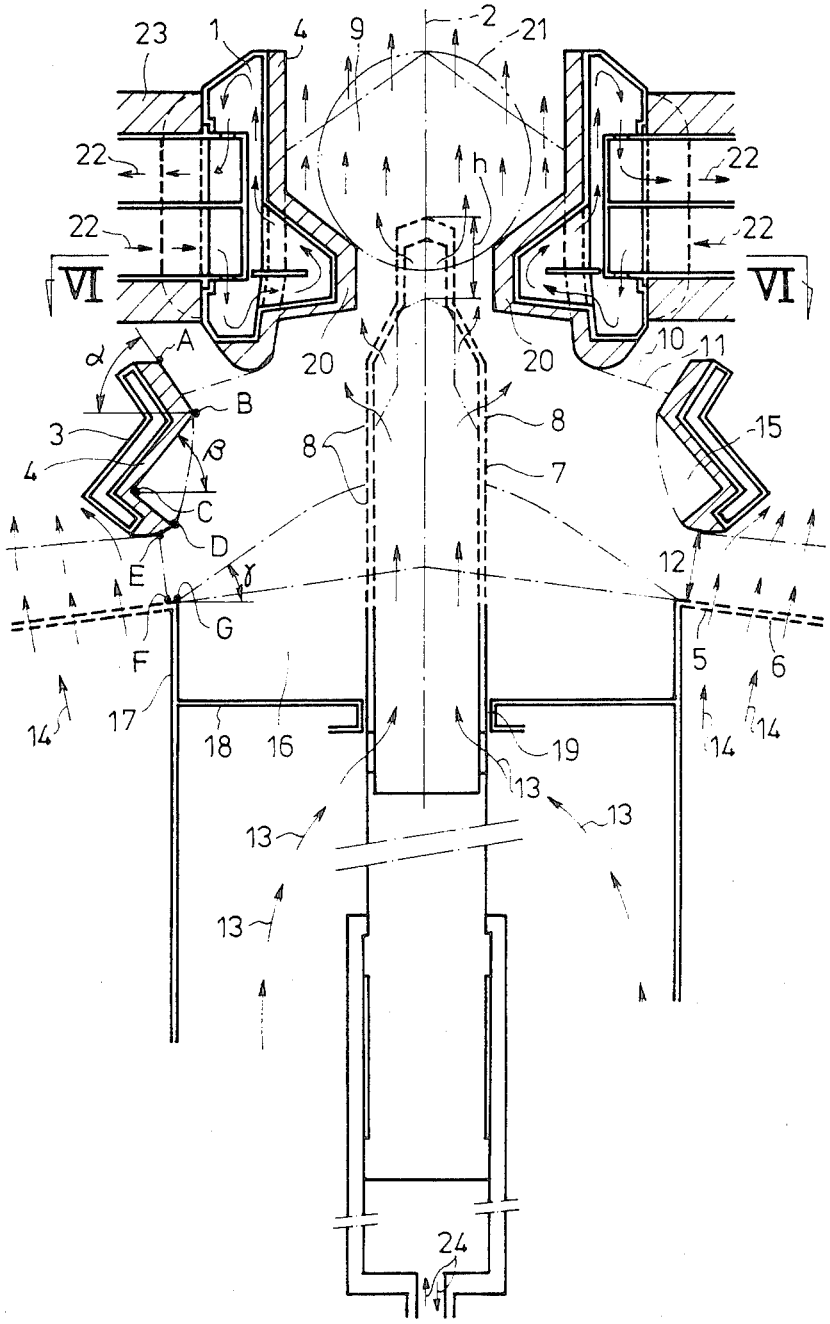
FIG. 5 is a vertical sectional view of a fifth embodiment of the present invention.

The protective cooling air is forced to flow through the guide tube 1 and the outer tube 3 and a supporting member (indicated by the reference number 23 in FIG. 5). The outer surfaces of the guide tube 1, the outer tube 3 and the supporting member 23 are lined with refractory brick or castable 4 so as to protect the outer surfaces from high temperature heat.

Figure 2:
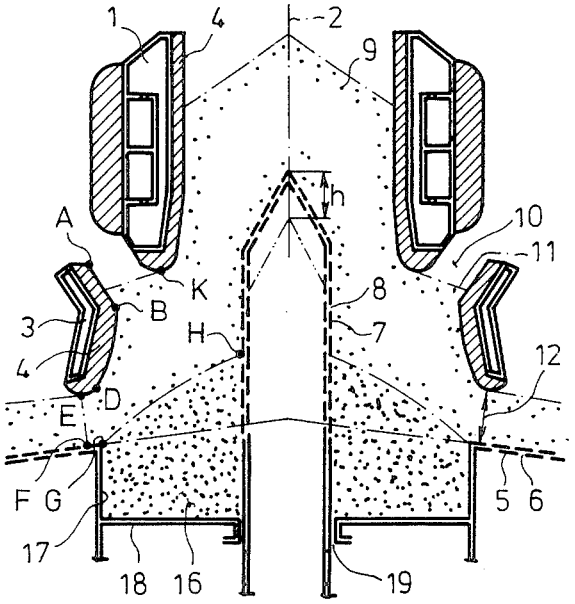
FIG. 2 is a vertical sectional view of a second embodiment of the present invention.

FIG. 2 shows a second embodiment of the present invention. In the first embodiment shown in FIG. 1, the arc BD defines the tarrying zone 15; but in the second embodiment as shown in FIG. 2, the boundary surface generated by the arc BD is a part of the inner wall surface of the outer tube 3. Except this, the second embodiment is substantially similar in construction to the first embodiment.

Figure 3:
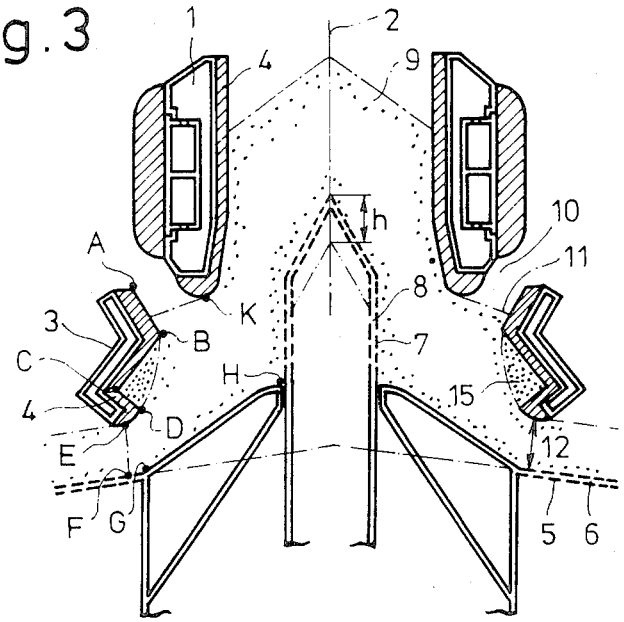
FIG. 3 is a vertical sectional view of a third embodiment of the present invention.

FIG. 3 shows a third embodiment of the present invention. While in the first embodiment described above with reference to FIG. 1, the tarrying zone 16 is defined by the arc GH, the surface generated by the arc GH in the third embodiment constitutes a part of the conical or pyramidal body 5. Except this, the third embodiment is substantially similar in construction to the first embodiment.

Figure 4:
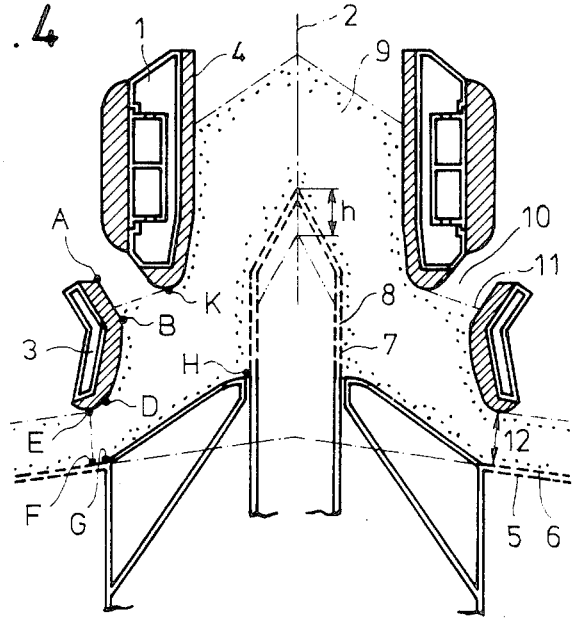
FIG. 4 is a vertical sectional view of a fourth embodiment of the present invention.

FIG. 4 shows a fourth embodiment of the present invention in which the inner wall of the outer tube 3 is substantially similar to that in the second embodiment described above with reference to FIG. 2 and the upper central portion of the conical or pyramidal body 5 is substantially similar to that in the third embodiment described above with reference to FIG. 3. Except these two features, the fourth embodiment is substantially similar in construction to the first embodiment described above with reference to FIG. 1.

Figure 6:
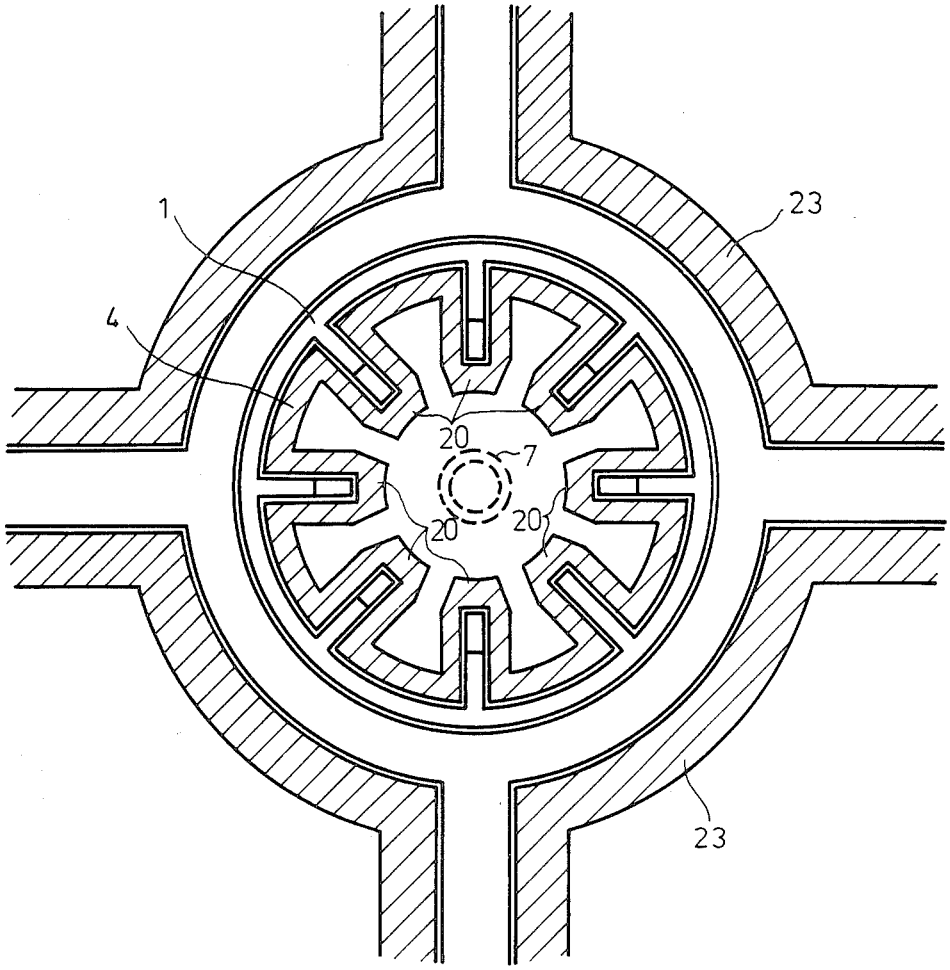
FIG. 6 is a sectional view taken along the line VI—VI of FIG. 5.

FIGS. 5 and 6 show a fifth embodiment of the present invention in which high-temperature large- or medium-sized lumps 21 can be crushed. Reference numeral 20 designates a projection of refractory brick or castable 4 lined over the inner wall surface of the guide tube 1. The projections 20 extend radially inwardly toward the axis 2 as best shown in FIG. 6. The spacing between the adjacent projections 20 and the spacing between the projections 20 and the motion acceleration device 7 are smaller than a permissible particle size and than the thickness of the moving layer of the high-temperature particles 9 along the outer surface of the conical or pyramidal body 5. Reference numeral 22 designates an arrow indicating the direction of the flow of the cooling air for protecting the guide tube 1 and the guide tube supporting member 23 from high temperature; and 24, arrows indicating the directions of the flows of the compressed air for activating the motion acceleration device 7.

With the apparatus for cooling high-temperature particles of the type described above with reference to FIGS. 5 and 6, the cross sectional areas of the high-temperature particle passages in the guide tube 1 are smaller than a permissible particle size because a plurality of projections 20 are provided as descrbied above. Therefore, the high-temperature particles 9 whose particle sizes are smaller than a predetermined permissible particle size smoothly move downward through the guide tube 1, but a large-sized or medium-sized lump whose size is larger than a predetermined permissible particle size is prevented by the projections 20 from being dropped so that it temporarily stays in the guide tube 1. In this case, as the motion acceleration device 7 vertically reciprocates, the upper leading end thereof strikes the lump 21, thereby breaking it into small-sized particles. This can be accomplished easily because the large-sized or medium-sized lumps 21 which have been just discharged out of the rotary kiln and have not been cooled yet are very fragile. In other words, when the large- or medium-sized lump 21 is cooled, its strength is remarkably increased so that it requires a great force to break it into smaller particles. It follows, therefore, that it is advantageous to break the lump 21 into smaller particles while it is still hot as described above. The crushed particles whose sizes are smaller than a predetermined particle size move down through the guide tube 1 onto the conical or pyramidal body 5 where the crushed particles are cooled by the air.

Figure 7:
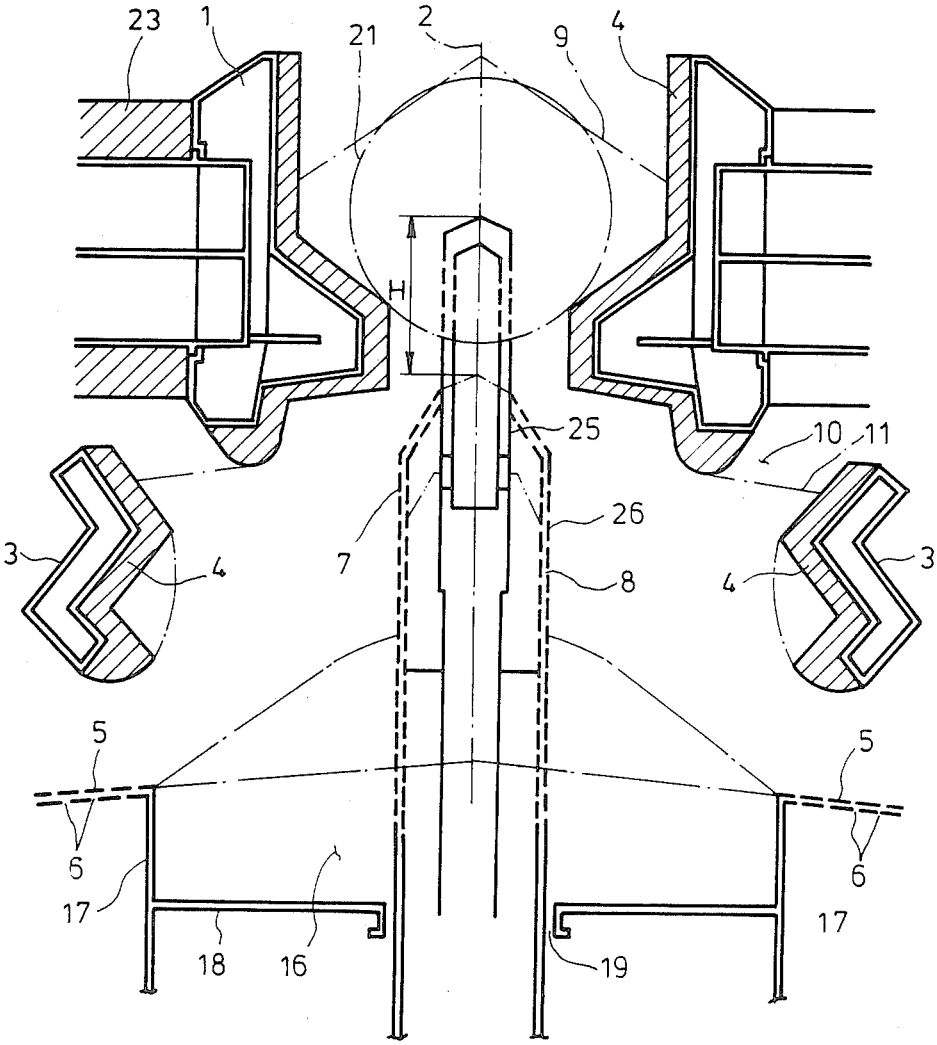
FIG. 7 is a vertical sectional view of a sixth embodiment of the present invention.

FIG. 7 shows a sixth embodiment of the present invention in which the motion acceleration device 7 comprises an inner tube 25 and an outer tube 26. The vertical stroke H of the motion acceleration device 7 in the sixth embodiment shown in FIG. 7 is longer than the stroke h of the motion acceleration device 7 of the type shown in FIG. 5 so that large-sized and medium-sized lumps are more easily broken into smaller particles.

Same reference numerals are used to designate similar parts throughout FIGS. 1–7.

In the apparatus for cooling high-temperature particles in accordance with the present invention, the guide tube and the outer tube which is interposed between the guide tube and the conical or pyramidal body coaxially of the guide tube constitute a double-guide-tube system. The free surface of the high-temperature particle layer is formed in the annular opening defined between the guide tube and the outer tube. Therefore, part of the air which flows through the motion acceleration device to mix and cool the high-temperature particles remaining in the guide tube is prevented from being directed toward the moving high-temperature particle layer along the outer surface of the conical or pyramidal body, but is directed toward the annular opening. In addition, the upper end of the outer tube is slightly higher than the lower end of the guide tube so that influence of the decrease in angle of repose of the high-temperature particles due to the air flow for mixing and cooling the high-temperature particles in the guide tube is prevented and consequently the free surface can be maintained in a stable manner. Moreover, the passage for the high-temperature particles defined in the outer tube is gradually converged toward the layer thickness control gap defined between the lower end of the outer tube and the conical or pyramidal dody so that the high-temperature particles are applied with an optimum pressure as they move toward the layer thickness control gap. As a result, various factors which disturbe the stability of the high-temperature particle layer formed over the conical or pyramidal dody can be substantially eliminated because the free surface of the high-temperature particles in the annular opening exhibits the stabilizing effect and the high-temperature particles which move through the passage defined in the outer tube are applied with an optimum pressure. Furthermore, the guide tube has a plurality of radially inwardly extended projections and the spacing between the adjacent projections and the spacing between the projections and the motion acceleration device are smaller than a predetermined permissible particle size so that the cross sectional areas of the high-temperature particle passages defined in the guide tube are smaller than a predetermined permissible particle size. Therefore, the high-temperature particles whose sizes are smaller than a predetermined permissible particle size are permitted to freely drop through the guide tube, but high-temprature large-sized or medium-sized lumps whose sizes are greater than a predetermined permissible particle size temporarily stay on the projections in the guide tube and then are broken into smaller particles when the upper end of the motion acceleration device, which is vertically reciprocable, strikes the large-sized or medium-sized lump trapped by the projections while it is still hot. As a consequence, the breakers or the like which are indispensable in the above-described conventional grate type cooler can be eliminated. In addition, the performance of the cooling apparatus of the type described in Japanese Patent Application Nos. 2226/1983 and 2227/1983 can be remarkably improved and positively ensured.

What is claimed:

1. In an apparatus for cooling high-temperature particles having a first cooling zone comprising a vertical guide tube which temporarily holds the high-temperature particles fed therein and prevents rapid spread of said high-temperature particles in radially outward directions, a conical or pyramidal body which has a large number of air passage holes and is disposed spaced below said guide tube such that an imaginary vertex of said conical or pyramidal body is coaxially on an axis of said guide tube and whose inclination angle is gentle, and a motion acceleration device which has a large number of air passage holes and which extends from the imaginary vertex of said conical or pyramidal body into said guide tube and is vertically reciprocable so that displacement in the radially outward directions of said high-temperature particles along an outer surface of said conical or pyramidal body is facilitated, and a second packed layer type cooling zone disposed below said first cooling zone for gradually cooling said high-temperature particles while said high-temperature particles which have been rapidly cooled in said first cooling zone move downwards, the improvement which comprises a vertical outer tube interposed between said guide tube and said conical or pyramidal body coaxially of said guide tube to constitute together with said guide tube a double guide tube system, said outer tube having an upper end positioned slightly higher than a lower end of said guide tube so that a free surface of a high-temperature particle layer formed in an annular opening defined between said guide tube and said outer tube can be stabilized, and a passage for said high-temperature particles defined in said outer tube, said passage being gradually converged toward a layer thickness control gap defined between the lower end of said outer tube and said conical or pyramidal body so that said high-temperature particles which move from said outer tube to said conical or pyramidal body can be be applied with a pressure and compacted.

2. An apparatus according to claim 1 wherein said guide tube has a plurality of internal projections extending radially inwardly toward the axis of said guide tube, spacing between the adjacent projections and spacing between the projections and said motion acceleration device being maintained smaller than a predetermined permissible particle size so that a large-sized or medium-sized lump contained in the high-temperature particles fed into said guide tube can be temporarily held and then broken into smaller particles by vertical movement of said motion acceleration device while it is still hot.

3. An apparatus according to claim 2 wherein said motion acceleration device comprises an inner tube and an outer tube so that said motion acceleration device performs a double action.

* * * * *